US005444201A

United States Patent [19]

Schulman et al.

[11] Patent Number: 5,444,201

[45] Date of Patent: Aug. 22, 1995

[54] MULTIPLE ELECTRODE STRUCTURE FOR A VACUUM INTERRUPTER

[75] Inventors: Michael B. Schulman, Pittsburgh; Paul G. Slade, Wilkinsburg, both of Pa.

[73] Assignee: Eaton Corporation, Cleveland, Ohio

[21] Appl. No.: 155,376

[22] Filed: Nov. 22, 1993

[51] Int. Cl.[6] ..... H01K 33/66

[52] U.S. Cl. ..... 218/118

[58] Field of Search ..... 200/144 R, 144 B, 275, 200/279

[56] References Cited

U.S. PATENT DOCUMENTS

| | | | |
|---|---|---|---|
| 3,522,399 | 7/1970 | Crouch | 200/144 B |
| 3,809,836 | 5/1974 | Crouch | 200/144 B |
| 4,553,007 | 11/1985 | Wayland | 200/144 B |
| 5,103,069 | 4/1992 | Yorita | 200/144 B |

OTHER PUBLICATIONS

Paul G. Slade, "The Vacuum Interrupter Contact", Mar., 1984, IEEE Trans. Comp. Hybrids Package vol. CHMT-7, pp. 25-32.

M. Bruce Schulman, "Separation of Spiral Contacts and the Motion of Vacuum Arcs at High AC Currents," Oct., 1993, IEEE Trans. Plasma Sci., vol. PS-21, No. 5.

*Primary Examiner*—Marc S. Hoff
*Assistant Examiner*—Michael A. Friedhofer
*Attorney, Agent, or Firm*—Martin J. Moran

[57] ABSTRACT

A multiple electrode structure for a vacuum interrupter that encourages formation of a diffuse arc includes a pair of disk-shaped, confronting electrical contacts that are relatively movable between a closed circuit position and an open circuit position and that are enclosed by a vacuum envelope. Each contact has generally spiral-shaped arms defining slots therebetween. The slots gradually widen towards the periphery of the contacts. In addition, the contacts are rotated relative to each other such that the tip of each spiral arm of one contact faces a generally radially extending portion of a spiral arm of the other contact. A generally tubular metal vapor shield surrounds the contacts within the envelope and is electrically isolated from at least one of the contacts in the open circuit position. The design and orientation of the contacts increases the radial component of the self-induced magnetic fields generated by the current in the interrupter. The Lorentz force on a high-current columnar arc between the contacts motivates the arc to attach to the vapor shield and become diffuse.

6 Claims, 4 Drawing Sheets

MULTIPLE ELECTRODE STRUCTURE FOR A VACUUM INTERRUPTER

BACKGROUND OF THE INVENTION

1. Field of the Invention

This invention relates to vacuum interrupters and, more particularly, the design and arrangement of slotted disk-shaped contacts for high-current vacuum interrupters.

2. Description of the Prior Art

Vacuum interrupters are typically used, for instance, to reliably interrupt medium to high voltage ac currents of several thousands of amperes or more. They generally include a vacuum envelope enclosing a pair of facing contact electrodes that are relatively movable between a closed circuit position and an open circuit position. Each contact is connected to a current-carrying terminal post extending outside the vacuum envelope. Surrounding the contacts within the envelope is a vapor condensing shield aligned concentrically with the contacts and terminal posts.

When the contacts are moved apart from the closed circuit position to the open circuit position, arcing of the current between the contacts occurs before the current is interrupted. The arcing can seriously damage the contacts, reducing the useful life of an interrupter. Metal from the contacts that is vaporized by the arc condenses back onto the contacts and also on the vapor shield, protecting the insulating vacuum envelope from accumulating deposits of metal.

The designs of practical commercial high-current vacuum interrupters have evolved over the past thirty years into two main types of contact arrangements, discussed in an article authored by one of the present inventors. P. G. Slade, *The Vacuum Interrupter Contact,* IEEE TRANS. ON COMPONENTS, HYBRIDS, AND MFG. TECH., Vol. CMHT-7, No. 1, p. 25–32, March 1984, included in this specification by reference. Each type produces a magnetic field which helps to control the initially columnar arc and promote its transition to a diffuse mode. In a first type, an axial magnetic field is generated in the contact region that forces the high-current arc to rapidly become diffuse and continuously distributed within the contact gap. In a second type, a magnetic field is impressed perpendicular to the arc column in a direction which forces the arc to move rapidly around the circular periphery of the contact surface. This can be accomplished using slotted-cup or spiral-shaped arm contacts, wherein the magnetic field is self generated by the ac current. In some contact designs of this type, the confronting contacts each have a four-slot arrangement that mirrors the other contact, rotated by about 45°, as disclosed in U.S. Pat. No. 3,809,836 to Crouch.

During high-current arcing with present spiral-arm contact designs and a metal shield, it has been observed that the Lorentz force drives the arc along the periphery of the contacts. The arc column is frequently perturbed by a slot located between two arms and expands outward to burn from one contact to the shield and back to the other contact. The arc takes on a more diffuse appearance and continues its azimuthal motion in this condition until it reverts back to a column in the gap between the contacts. However, adverse effects can reduce the probability of successful current interruption. The contact slots can be bridged due to melting of the spiral-shaped arms, or petals of the contact, especially when a columnar arc becomes stationary at the tip of a contact petal. The longer a columnar arc remains stationary at the tip, the greater is the melting of the contact at that spot. The columnar arc can become anchored at a position between the contacts at a slot, especially where a slot has become bridged due to melting of the contacts. The arc becomes even more firmly anchored, severely eroding the arc roots, and sometimes leading to interruption failure. Adjacent to this position, the shield can suffer heavy melting.

The radial component of the force on the arc column can force the arc to attach to the nearby vapor shield which then becomes, in effect, a third electrode. This occurs most frequently when the arc is passing over or is fixed at a slot at the contact periphery. With judicious choice of shield material and thickness, the shield can withstand the energy of the arc. For a description of an appropriate type of vapor shield, the reader is referred to U.S. Pat. No. 4,553,007 to Wayland, assigned to the assignee of the present invention, and included in this specification by reference. The striking of the arc upon the vapor shield can be advantageous, because once the arc is attached to the shield the arc spreads out, reducing the energy deposited at the contact petal tip. A fixed arc can then resume its tendency toward circumferential motion. The shield does not sustain serious damage where the arc attaches unless the nearby contact slot has already been bridged.

There is therefore a need for a spiral-arm vacuum interrupter having a contact arrangement that delays bridging of the slots until higher currents, and that encourages the participation of the vapor shield as a third electrode in arcing between the contacts.

SUMMARY OF THE INVENTION

This need and others are satisfied with the present invention for a vacuum interrupter having a vacuum envelope, a pair of coaxially aligned, disk-shaped contacts within the envelope that are relatively movable between a closed circuit position and an open circuit position, terminal posts connected to each of the contacts and extending outside the vacuum envelope for carrying an electrical current when the contacts are in the closed circuit position, and a metal vapor shield surrounding the contacts within the vapor shield.

The contacts each have a body that has spaced apart first and second sides. The first side includes a substantially annular contacting face that confronts the other contact and is capable of engaging the other contact in the closed circuit position. A centrally located dimple can preferably be located radially inside the contacting face. Radially outside the contacting face, the first side of each contact is preferably beveled away from the other contact. Each contact has a plurality of circumferentially spaced, substantially spiral-shaped arms, and a like plurality of slots defined by the arms and extending between the first and second sides. Each of the slots has an inner and an outer edge extending from an opening at the peripheral edge of the contact to an inner position that is radially inside the beveled portion of the contact. The width of each slot gradually widens from a medial position proximate an outer radius of the contacting face to the opening. The widening of-the slots near the peripheral edge serves to prevent bridging.

According to another aspect of this invention, each contact has four arms defining four L-shaped slots. Each slot includes a tangential portion extending across the outer, beveled portion of the contact from the opening to the medial position via a path substantially tangent to the outer radius of the contacting face and a radial portion extending about perpendicular to the first portion and into the contacting face from the medial position to the inner position. The included angle between the inner and outer edges of the tangential portion is in a range between about three degrees and about ten degrees.

According to another aspect of this invention, each arm has a petal portion defined by the peripheral edge of the contact and the outer edge of the tangential portion of one of the slots, and a linear portion that includes the remainder of the arm not so defined. The boundary between the petal portion and the linear portion is a line extending generally radially from about the medial position to the peripheral edge. The contacts are angularly displaced relative to each other so that the tip of the petal portion of each arm of one contact confronts a linear portion of an arm on the other contact.

It is an object of this invention to provide a vacuum interrupter that has a high current interruption capacity.

It is another object of this invention to provide a more durable vacuum interrupter having a spiral-arm contact design in which bridging of the slots by melting is reduced.

It is another object of this invention to provide a vacuum interrupter having a spiral-arm contact design that enhances arc transfer to the vapor shield.

It is another object of this invention to provide a contact arrangement that encourages the participation of the vapor shield as a third electrode in arcing between the contacts.

These and other objects of the present invention will be more fully understood from the following description of the invention with reference to the illustrations appended hereto.

DETAILED DESCRIPTION OF THE INVENTION

Figure 1:
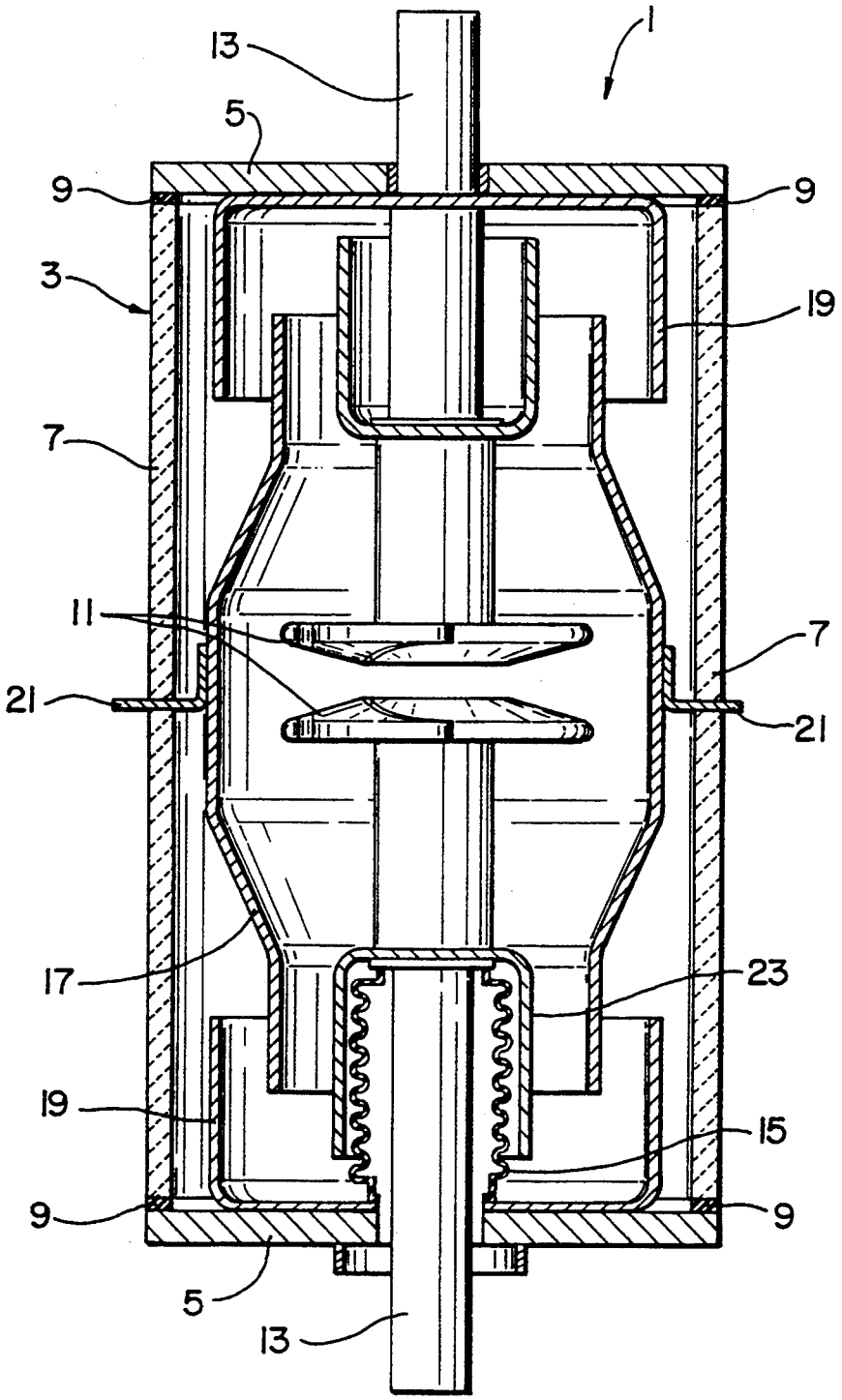
FIG. 1 is a longitudinal section view through a vacuum interrupter of the present invention.

Referring now to FIG. 1, the basic components of a typical vacuum interrupter 1 are displayed. A vacuum envelope 3 enclosing the internal components includes spaced apart end caps S and a tubular, insulating casing 7 joined together by metal-to-insulation vacuum seals 9. The envelope 3 is evacuated to a pressure of $\approx 10^6$ Torr. Located within the envelope 3 is a pair of disk-shaped electrical contacts 11, shown here in their open circuit position. Each contact is connected to an electrical terminal 13 that extends outside the envelope 3 through an end cap 5. A bellows assembly 15 incorporated into one of the terminals 13 allows the contacts 11 to be relatively movable between the closed circuit position and the open circuit position. The open-circuit separation between the contacts 11 typically is 7–17 mm, depending upon the size of the vacuum interrupter. Surrounding the contacts 11 is a generally cylindrical, metal vapor condensing shield that is electrically isolated from at least one of the contacts. End shields 19 protect the end caps 5. A central support 21 connected to the insulating casing 7 supports the vapor shield 17 in this embodiment such that it is electrically isolated from the contacts 11. In an alternative embodiment, the vapor shield 17 is electrically isolated from only one of the contacts 11 when they are in the open circuit position. A bellows shield 23 further protects the bellows assembly 15.

Figure 2:
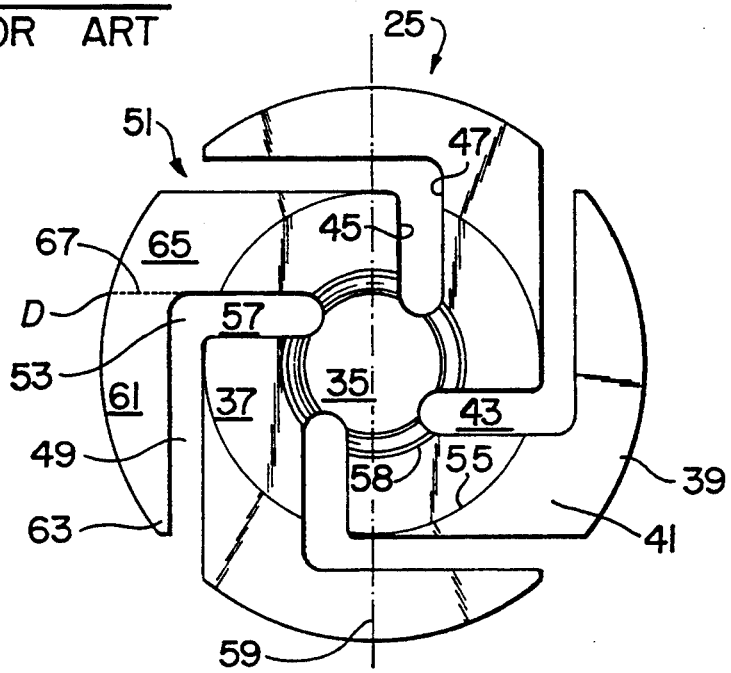
FIG. 2 PRIOR ART
FIG. 2 is a plan of a spiral-arm contact structure of the prior art.
Figure 3:
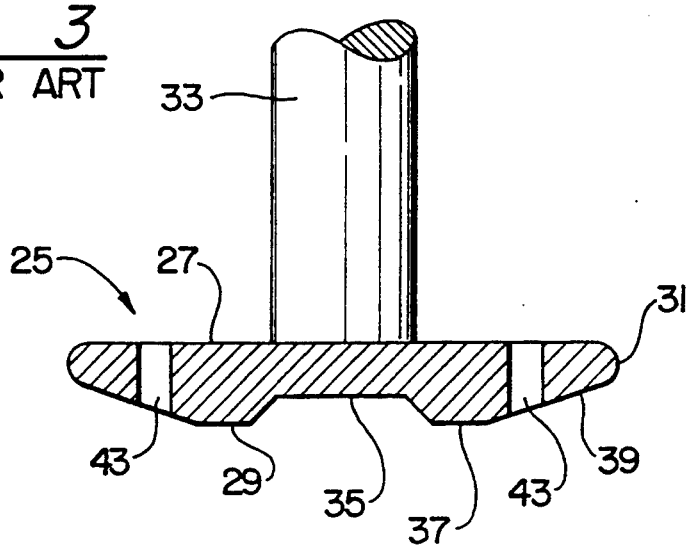
FIG. 3 PRIOR ART
FIG. 3 is a side view of the prior art contact of FIG. 2.

Referring now to FIGS. 2 and 3, a typical spiral-arm contact of the prior art is a disk-shaped member 25 having spaced apart first and second sides 29 and a peripheral edge 31. The first side 27 is connected on axis to a current-carrying terminal post 33. The second side 29 has a central dimple 35, an annular contacting face 37 that engages the contacting face of the other contact in the closed circuit position, and an annular beveled region 39 radially outside the contacting face 37. The contact has four circumferentially spaced apart arms 41 that define L-shaped slots 43 extending between the first and second sides 27, 29. For a typical contact having a diameter of 2.425 inches (6.16 cm), the central dimple has a diameter of 0.625 inches (1.588 cm) and the contacting face has an outer diameter of 1.5 inches (3.81 cm). For a typical design of a smaller contact having a diameter of 1.75 inches (4.445 cm), the dimple has a 0.425 inch (1.08 cm) diameter and the contacting face has a 1.05 inch (2.667 cm) outer diameter.

Each slot 43 has parallel edges, an inner edge 45 being generally closer to the center of the contact than an opposing, outer edge 47. Each slot has a tangential portion 49 extending through the beveled region 39 from an opening 51 at the peripheral edge 31 of the contact to a medial position 53 via a path wherein the inner edge 45 extends about tangent to the outer radius 55 of the contacting face 37. Each slot 43 also has a radial portion 57 extending about perpendicular to the tangential portion 49 from the medial position 53 to a position proximate the boundary 58 between the contacting face 37 and the inner dimple 35. The inner edge 45 of the radial portion 57 runs about parallel to a diameter 59 of the contact as shown. The contact arms 41 each have a petal portion 61 that includes the peripheral tip 63 of the arm. Each petal portion 61 is bounded by the peripheral edge 31 of the contact and the outer edge 47 of the tangential portion 49 of a slot. A linear portion 65 comprises the remainder of the arm 41. The boundary 67 between the petal portion 61 and the linear portion 65 of each of the spiral arms 41 is designated by a dotted line extending colinearly with the outer edge 47 of the radial portion 57 from the exterior corner of one of the L-shaped slots to a point D at the peripheral edge 31.

Figure 4:
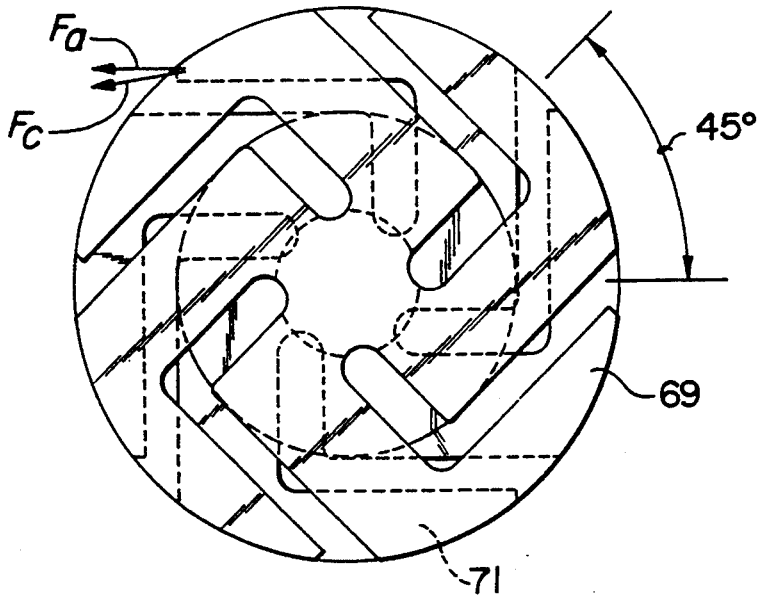
FIG. 4 PRIOR ART
FIG. 4 is a rear plan view of the prior art anode contact of FIGS. 2–3 superimposed over a confronting cathode contact with a relative rotation of 45°.

A typical contact arrangement for prior art vacuum interrupters orients the spiral pattern of the confronting anode 69 and cathode 71 contacts similarly, but with the spiral patterns rotated about 45° relative to each other as illustrated in FIG. 4. While reference is made in this specification to "anode" and "cathode" contacts, it will be understood that this identification of elements is used for convenience of expression only, and that the functional role of anode and cathode will alternate between the two contacts with the cycling of the a.c. current through the vacuum interrupter. Currents in the anode 69 and cathode 71 produce magnetic fields that create Lorentz forces $F_a$ and $F_c$ respectively, on the arc column. At the tip of a spiral petal 61, these are nearly parallel, and the radial component of the resultant Lorentz force is small. Although the azimuthal component of the Lorentz force is relatively large, we have found that (1) the arc can become anchored at a contact slot, and (2) it is easier for the central arc column to be blown out towards the shield when the Lorentz force has a significant radial component than it is to force an arc root to jump a slot when the force is nearly 100% azimuthal.

The above-described spiral-arm contact design and arrangement can be modified according to the present invention to force the arc between the contacts to pass through a floating vapor shield. Utilizing the vapor shield as an active electrode reduces the power density that the columnar arc delivers to the contacts through the arc roots. This reduces the tendency for the arc to anchor at a slot, an effect that can cause arc melting and bridging of the slots. The floating shield electrode dissipates the energy of a high-current arc more efficiently and can increase the interruption ability of vacuum interrupters having spiral contacts. According to the present invention, this is accomplished by (1) widening the slots near the periphery of the contacts, and (2) providing a relative rotation of the anode and cathode contacts such that the tips of the petal portions of one contact are aligned with the linear portions of the other electrode.

Figure 5:
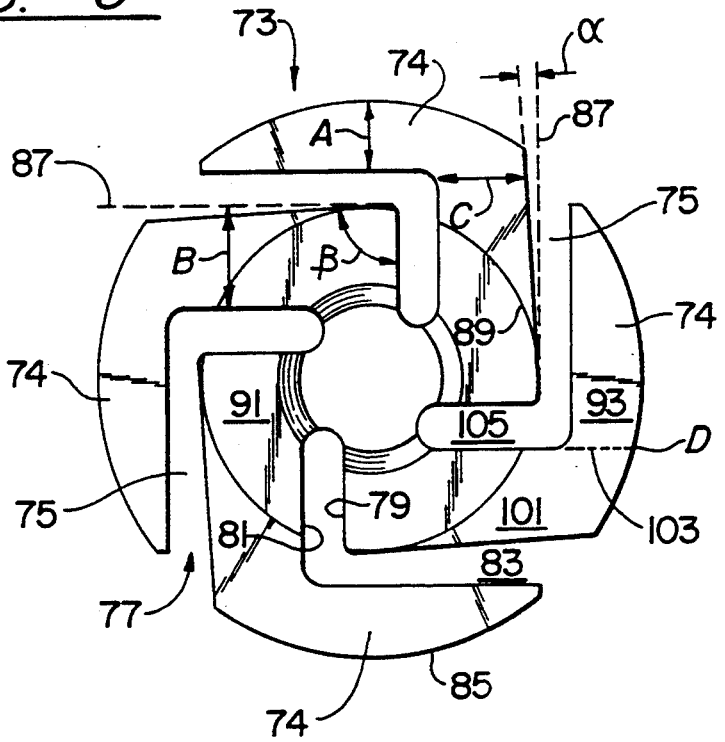
FIG. 5 is a plan view of a preferred embodiment of a spiral-arm contact of this invention.

Referring now to FIG. 5, a preferred embodiment of the vacuum interrupter of this invention includes contacts 73 having spiral-shaped arms 74 that are similar in most respects to the prior art design discussed above, but that additionally incorporate an angular cut to widen the slots 75 toward the openings 77. Instead of extending in parallel, as in the prior art, the inner 79 and outer 81 edges of the tangential portion 83 of each slot 75 spread apart toward the peripheral edge 85 of the contact. The inner edge 79 is preferably angled away from the outer edge 81 and away from a tangent 87 to the outer radius 89 of the contacting face 91 such that lines along the inner edge 79 form an acute angle $\beta$ as shown.

To provide a benefit in reducing slot bridging by melting of the contacts, the included angle $\alpha$ between the inner 79 and outer 81 edges can range from about 3° to about 10° with about 7° being optimum. The introduction of outward-angled slots 75 will best reduce the bridging of the slots without impairing the strength of the petal portions 93 when dimension C is approximately equal to or slightly larger than dimension A. The ratio A/B should range from about 0.5 to about 1.0, with about 0.7 being the preferred ratio. According to our observations, this innovation is beneficial when the contact diameter is greater than about 1.75 inches, and when the arc current is greater than about 14kA rms. However, it may provide benefits at even lower currents with spiral-arm contact designs that are different from that shown by the figures, and the invention is not limited to a particular current interruption range.

Figure 6:
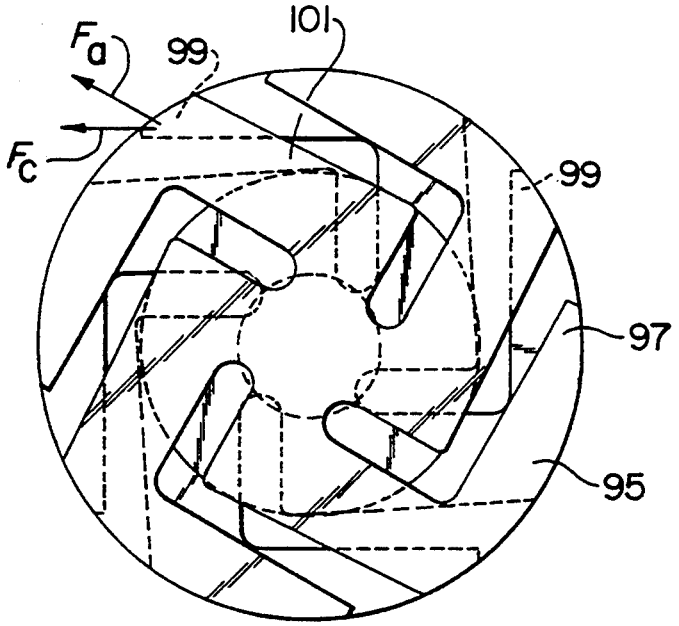
FIG. 6 is a rear plan view of the anode contact of FIG. 5 superimposed over a confronting cathode and rotated relative to the cathode according to one aspect of this invention.

Referring now also to FIG. 6, anode 95 and cathode 97 contacts of the design shown in FIG. 5 are rotated relative to each other such that each of the tips 99 of the petal portions 93 of the cathode 97 face linear portions 101 of the spiral arms of the anode 95. Note, however, that this arrangement generally does not orient each of the tips of the petal portions of the anode over linear portions of the spiral arms of the cathode. The boundary 103 between a linear portion 101 and a petal portion 93 is designated by a dashed line extending about colinearly with the outer edge 81 of the radial portion 105 of a slot 75 to a point D at the peripheral edge In contrast to the small radial component of the Lorentz force on the columnar arc for the prior art arrangement shown in FIG. 4, the Lorentz force due to current in the tip of the anode 95 of the current invention has a large radial component (See FIG. 6). The enhanced radial force encourages the arc column at the slot 75 to attach to the nearby vapor shield 17 for currents at which the arc otherwise would tend to anchor and melt the spiral tip 99. For the four-slot design illustrated in the figure, a relative rotation greater than about 55° and less than about 65° produces the desired effect. Due to the symmetry of the design, a relative rotation greater than about 25° and less than about 35° provides an equivalent effect. For different spiral-arm designs the preferred relative rotation angle may, of course, be different, and it is understood that the invention is not limited to a fixed rotation angle for all possible contact designs.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

We claim:

1. A vacuum interrupter, comprising:

a vacuum envelope;

first and second coaxially aligned contact means relatively movable between a closed circuit position and an open circuit position, each including:

a substantially disk-shaped contact within the envelope, characterized by spaced apart first and second sides, a peripheral edge, a contacting face on the first side confronting the other contact and engageable with the other contact in the closed circuit position, and a plurability of circumferentially spaced, substantially spiral-shaped arms defining L-shaped slots therebetween, each slot having inner and outer edges extending axially between the first and second sides and extending from an opening at the peripheral edge to an inner position, each slot being characterized by a first portion having a width that decreases from the opening to a medial position radially outside the inner position;

terminal means connected to the second side of the contact and extending outside the envelope for carrying an electrical current when the contacts are in the closed circuit position;

wherein each of the arms comprise:

a petal portion defined by the peripheral edge of the contact and the outer edge of one of the slots;

a linear portion being that portion of the arm not including the petal portion, wherein the boundary between the petal portion and the linear portion is a line extending generally radially from about the medial position to the peripheral edge and wherein the contacts are relatively rotated by a rotation angle that is greater than about 55° and less than about 65° such that a peripheral tip of the petal portion of each of the arms of one of the contacts confronts the linear portion of an arm of the other contact.

2. A vacuum interrupter comprising:

a vacuum envelope;

first and second coaxially aligned contact means relatively movable between a closed circuit position and an open circuit position, each including:

a substantially disk-shaped contact within the envelope, characterized by spaced apart first and second sides, a peripheral edge, a contacting face on the first side confronting the other contact and engageable with the other contact in the closed circuit position, and a plurability of circumferentially spaced, substantially spiral-shaped arms defining L-shaped slots therebetween, each slot having inner and outer edges extending axially between the first and second sides and extending from an opening at the peripheral edge to an inner position, each slot being characterized by a first portion having a width that decreases from the opening to a medial position radially outside the inner position;

terminal means connected to the second side of the contact and extending outside the envelope for carrying an electrical current when the contacts are in the closed circuit position;

wherein each of the arms comprise:

a petal portion defined by the peripheral edge of the contact and the outer edge of one of the slots;

a linear portion being that portion of the arm not including the petal portion, wherein the boundary between the petal portion and the linear portion is a line extending generally radially from about the medial position to the peripheral edge and wherein the contacts are relatively rotated by a rotation angle that is greater than about 25° and less than about 35° such that a peripheral tip of the petal portion of each of the arms of one of the contacts confronts the linear portion of an arm of the other contact.

3. A vacuum interrupter comprising:

a vacuum envelope;

first and second coaxially aligned contact means relatively movable between a closed circuit position and an open circuit position, each including:

a substantially disk-shaped contact within the envelope, characterized by spaced apart first and second sides, a peripheral edge, a contacting face on the first side confronting the other contact and engageable with the other contact in the closed circuit position, and a plurability of circumferentially spaced, substantially spiral-shaped arms defining L-shaped slots therebetween, each slot having inner and outer edges extending axially between the first and second sides and extending from an opening at the peripheral edge to an inner position, each slot being characterized by a first portion having inner and outer edges, the inner and outer edges of the first portion of each slot have an included angle ranging from about 3° to about 10°, such that the width that decreases from the opening to a medial position radially outside the inner position;

terminal means connected to the second side of the contact and extending outside the envelope for carrying an electrical current when the contacts are in the closed circuit position;

wherein each of the arms comprise:

a petal portion defined by the peripheral edge of the contact and the outer edge of one of the slots;

a linear portion being that portion of the arm not including the petal portion, wherein the boundary between the petal portion and the linear portion is a line extending generally radially from about the medial position to the peripheral edge and wherein the contacts are relatively rotated by a rotation angle that is greater than about 25° and less than about 35° such that a peripheral tip of the petal portion of each of the arms of one of the contacts confronts the linear portion of an arm of the other contact.

4. A vacuum interrupter, comprising:

a vacuum envelope;

first and second coaxially aligned contact means relatively movable between a closed circuit position and an open circuit position, each including:

a substantially disk-shaped contact within the envelope, characterized by spaced apart first and second sides, a peripheral edge, a contacting face on the first side confronting the other contact and engageable with the other contact in the closed circuit position, and a plurability of circumferentially spaced, substantially spiral-shaped arms defining L-shaped slots therebetween, each slot having inner and outer edges extending axially between the first and second sides and extending from an opening at the peripheral edge to an inner position, each slot being characterized by a first portion having inner and outer edges, the inner and outer edges of the first portion of each slot have an included angle ranging from about 3° to about 10° such that the width that decreases from the opening to a medial position radially outside the inner position;

terminal means connected to the second side of the contact and extending outside the envelope for carrying an electrical current when the contacts are in the closed circuit position;

wherein each of the arms comprise;

a petal portion defined by the peripheral edge of the contact and the outer edge of one of the slots;

a linear portion being that portion of the arm not including the petal portion, wherein the boundary between the petal portion and the linear portion is a line extending generally radially from about the medial position to the peripheral edge and wherein the contacts are relatively rotated by a rotation angle that is greater than about 55° and less than about 65° such that a peripheral tip of the petal portion of each of the arms of one of the contacts confronts the linear portion of an arm of the other contact.

5. A vacuum interrupter, comprising:

a vacuum envelope;

a pair of coaxial, substantially disk-shaped contacts within the envelope relatively movable between a closed circuit position and an open circuit position, each being characterized by:

spaced apart first and second sides;

a peripheral edge;

a substantially annular contacting face on the first side, oriented about coaxially with the contact, confronting the other contact and engageable with the other contact in the closed circuit position;

a substantially circular central dimple recessed from the contacting face;

a substantially annular beveled surface extending outward from the contacting face;

four circumferentially spaced, substantially spiral-shaped arms defining substantially L-shaped slots therebetween, wherein each slot extends between the first and second sides and comprises inner and outer edges, a tangential portion extending across the beveled surface from an opening at the peripheral edge to a medial position via a path substantially tangent to the outer radius of the contacting face, and a radial portion about transverse to the tangential portion and extending into the contacting face from the medial position via a path spaced apart from and oriented about parallel to a radius of the contact, the tangential portion having a width that increases from the medial position to the opening, and wherein each of the spiral arms comprises a petal portion including a peripheral tip of the spiral-arm, the petal portion extending between the peripheral edge and the outer edge of the tangential portion of one of the slots, and a linear portion extending in a first direction between the peripheral edge and the central dimple and extending in a second direction about transverse to the first direction between the outer edge of the radial portion of the one slot and inner edge of the tangential portion of a second slot, the contacts being further characterized in that each of the contacts is angularly displaced from the other such that a tip of the petal portion of each spiral-shaped arm of one contact confronts a linear portion of a spiral-shaped arm of the other contact;

terminal means connected to the second side of each of the contacts and extending outside the vacuum envelope for carrying an electrical current when the first and second contacts are in the closed circuit position;

a tubular metal vapor shield within the envelope, coaxially surrounding the contacts and electrically isolated from at least one of the contacts when the contacts are in the open circuit position;

each of the slots being characterized in that the inner and outer edges of the tangential portion have an included angle that is in a range between about 3° and about 10°;

each of the slots being characterized in that the outer edge of the tangential portion is about perpendicular to the radial portion; and the contacts being characterized in that each of the contacts is angularly displaced from the other contact about the central axis by more than about 55° and less than about 65°.

6. A vacuum interrupter, comprising:

a vacuum envelope;

a pair of coaxial, substantially disk-shaped contacts within the envelope relatively movable between a closed circuit position and an open circuit position, each being characterized by:

spaced apart first and second sides;

a peripheral edge;

a substantially annular contacting face on the first side, oriented about coaxially with the contact, confronting the other contact and engageable with the other contact in the closed circuit position;

a substantially circular central dimple recessed from the contacting face;

a substantially annular beveled surface extending outward from the contacting face;

four circumferentially spaced, substantially spiral-shaped arms defining substantially L-shaped slots therebetween, wherein each slot extends between the first and second sides and comprises inner and outer edges, a tangential portion extending across the beveled surface from an opening at the peripheral edge to a medial position via a path substantially tangent to the outer radius of the contacting face, and a radial portion about transverse to the tangential portion and extending into the contacting face from the medial position via a path spaced apart from and oriented about parallel to a radius of the contact, the tangential portion having a width that increases from the medial position to the opening, and wherein each of the spiral arms comprises a petal portion including a peripheral tip of the spiral-arm, the petal portion extending between the peripheral edge and the outer edge of the tangential portion of one of the slots, and a linear portion extending in a first direction between the peripheral edge and the central dimple and extending in a second direction about transverse to the first direction between the outer edge of the radial portion of the one slot and the inner edge of the tangential portion of a second slot, the contacts being further characterized in that each of the contacts is angularly displaced from the other such that a tip of the petal portion of each spiral-shaped arm of one contact confronts a linear portion of a spiral-shaped arm of the other contact;

terminal means connected to the second side of each of the contacts and extending outside the vacuum envelope for carrying an electrical current when the first and second contacts are in the closed circuit position;

a tubular metal vapor shield within the envelope, coaxially surrounding the contacts and electrically isolated from at least one of the contacts when the contacts are in the open circuit position;

each of the slots being characterized in that the inner and outer edge of the tangential portion have an included angle that is in a range between about 3° and about 10°;

each of the slots being characterized in that the outer edge of the tangential portion is about perpendicular to the radial portion; and the contacts being characterized in that each of the contacts is angularly displaced from the other contact by less than about 35° and more than about 25°.

* * * * *